US009850716B2

(12) United States Patent
Lin et al.

(10) Patent No.: US 9,850,716 B2
(45) Date of Patent: Dec. 26, 2017

(54) REMOTE-CONTROLLED ADJUSTABLE-SPEED SCREW DRILL FOR GAS-DRIVE HYDRAULIC-MOTIVE DURING GAS DRILLING

(71) Applicant: Southwest Petroleum University, Chengdu, Sichuan (CN)

(72) Inventors: Tiejun Lin, Sichuan (CN); Ying Zhang, Sichuan (CN); Zhanghua Lian, Sichuan (CN); Qiang Zhang, Sichuan (CN); Yong He, Sichuan (CN); Gao Li, Sichuan (CN); Taihe Shi, Sichuan (CN); Hao Yu, Sichuan (CN)

(73) Assignee: Southwest Petroleum University, Chengdu, Sichuan (CN)

( * ) Notice: Subject to any disclaimer, the term of this patent is extended or adjusted under 35 U.S.C. 154(b) by 0 days.

(21) Appl. No.: 15/144,821

(22) Filed: May 3, 2016

(65) Prior Publication Data

US 2016/0245063 A1 Aug. 25, 2016

(30) Foreign Application Priority Data

Dec. 31, 2015 (CN) ..... 2015 2 1137771 U

(51) Int. Cl.

| | |
|---|---|
| ***E21B 10/44*** | (2006.01) |
| ***E21B 21/16*** | (2006.01) |
| *E21B 44/00* | (2006.01) |
| *E21B 7/04* | (2006.01) |

(52) U.S. Cl.
CPC ..... *E21B 10/44* (2013.01); *E21B 21/16* (2013.01); *E21B 7/046* (2013.01); *E21B 44/005* (2013.01)

(58) Field of Classification Search
CPC ..... E21B 10/44; E21B 21/16
See application file for complete search history.

(56) References Cited

U.S. PATENT DOCUMENTS 3,749,185 A * 7/1973 Tiraspolsky ..... E21B 4/02 173/177

* cited by examiner

*Primary Examiner* — Giovanna C Wright
*Assistant Examiner* — Kristyn Hall

(57) ABSTRACT

A remote-controlled adjustable-speed screw drill for gas-drive hydraulic-motive during gas drilling is provided, including a piston speed control system, a motor assembly, a cardan shaft assembly and a transmission shaft assembly which are connected with each other from up to down in sequence. The motor assembly includes air inlets, a cam, air cylinders, pistons, a connecting rod, air outlets, liquid inlets, hydraulic cylinders, liquid check valves, a liquid storage chamber, liquid outlets, a liquid injecting chamber, a liquid injecting hole, an anti-drop cap, a rotor, a stator, and a motor assembly housing. The present invention utilizes the high-pressure gas injected by the gas drilling to drive the pistons to move back and forth at high-speed, so as to drive the incompressible liquid within the driving screw to achieve the self-circulating motion, and the screw rotor is driven to rotate by the liquid.

9 Claims, 7 Drawing Sheets

M-M

N-N

REMOTE-CONTROLLED ADJUSTABLE-SPEED SCREW DRILL FOR GAS-DRIVE HYDRAULIC-MOTIVE DURING GAS DRILLING

CROSS REFERENCE OF RELATED APPLICATION

The present invention claims priority under 35 U.S.C. 119(a-d) to CN 201521137771.1, filed Dec. 31, 2015.

BACKGROUND OF THE PRESENT INVENTION

Field of Invention

The present invention relates to a technical field of the drilling equipment, and more particularly is adapted for the gas drilling technology to drill directional wells, horizontal wells and highly deviated wells.

Description of Related Arts

Gas drilling is an underbalanced drilling mode which utilizes the gas (including air, nitrogen, natural gas and diesel exhaust) as the circulating medium, injects the high-pressure gas into the wells through the drill string by the ground gas compressor, depends on the energy of annular high-speed gas for bringing drill cuttings from the bottom hole back to the ground and detaching the solid/gas on the ground, and the detached combustible gas is released, dust-removed and noise-reduced. Currently, the gas drilling technology is universally well-known as a practical technology, which is capable of effectively shortening the drilling time, liberating the hydrocarbon zone and reducing the drilling cost. It has become an important means for efficiently developing the oil and gas fields. However, the conventional gas drilling technologies and equipments are mainly adapted for vertical wells, and unable to highly-effectively complete the directional drilling for forming directional wells, horizontal wells and highly deviated wells, which seriously limits the application ranges of the gas drilling. The main reason of the above shortcomings of the gas drilling is lack of the key downhole equipment, which is reliable and suitable for the directional drill of the gas drilling, namely, the gas drilling screw drill. The conventional gas drilling screw drills have basically same principles and structures with the liquid (mud drilling liquid) screw drills, and only the circulating medium is transformed from the incompressible liquid into compressible gas. Because the gas is the compressible medium, during application, the conventional gas screw drill outputs low torque, and unstable rotation speed and torque, which causes that the drill is stopped, and then rotates at high speed after being released, namely, the "overspeed" phenomenon, so that the conventional gas drilling screw drill has bad performance and low service life, is unable to stably, reliably and highly effectively drill directional wells.

The key to success of directional wells, horizontal wells and highly deviated wells by the gas drilling is to overcome the "overspeed" phenomenon of the gas screw for achieving the stable output of the gas drilling torque, and prolonging the service life of the drill. Therefore, the present invention designs a gas screw drill which is adapted for the directional wells, horizontal wells and highly deviated wells of the gas drilling, utilizes the gas-drive hydraulic-motion self-circulation, is able to achieve the ground remotely-controlled speed control and stably output the torque. The present invention is based on material mechanics, engineering mechanics and fluid dynamics, through reasonable designs, depends on the "engine" principles, sufficiently utilizes the high-pressure, high-flow and compressible circulating gas of the gas drilling to design the downhole "engine". It utilizes the high-pressure gas outputted by the ground compressor to drive the downhole screw piston mechanism to move up and down at high speed, so as to drive the uncompressible liquid in the screw to achieve the self-circulating motion, for allowing the liquid to drive the rotor to rotate, so that the energy directional transformation of the gas pressure energy-mechanical energy (piston)-hydraulic pressure energy-mechanical energy (rotor) is realized. Furthermore, the speed of the piston is remotely controlled by the ground, so that the rotation speed of the screw is not affected by the changing gas flow rate, for outputting the stable and large enough torque to the drilling bit, thereby achieving the directional drilling operation of the gas drilling.

SUMMARY OF THE PRESENT INVENTION

An object of the present invention is to provide a remote-controlled adjustable-speed screw drill for gas-drive hydraulic-motive during gas drilling, which is capable of stably outputting a torque and achieving a ground remotely-controlled adjustable-speed, and is adapted for a directional drilling operation of gas horizontal or directional drilling.

Accordingly, in order to accomplish the above object, a technical solution adopted by the present invention is: a remote-controlled adjustable-speed screw drill for gas-drive hydraulic-motive during gas drilling, comprising a piston speed control system, a motor assembly, a cardan shaft assembly and a transmission shaft assembly which are connected with each other from up to down in sequence; wherein:

the piston speed control system comprises a piston speed control housing, a polymer battery pack, a remotely-controlled circuit box, a piston speed control motor and a piston speed control shaft, wherein the polymer battery pack is located at an upper portion of the piston speed control housing, both the remotely-controlled circuit box and the piston speed control motor are located at the piston speed control housing and below the polymer battery pack in sequence, the piston speed control shaft is connected with a lower portion of the piston speed control motor and extends downwardly;

the motor assembly comprises an air inlet A, an air inlet B, a cam, an air cylinder A, an air cylinder B, a piston A, a piston B, a connecting rod, an air outlet A, an air outlet B, a liquid inlet A, a liquid inlet B, a hydraulic cylinder A, a hydraulic cylinder B, a liquid check valve A, a liquid check valve B, a liquid storage chamber, a liquid outlet A, a liquid outlet B, a liquid injecting chamber, a liquid injecting hole, an anti-drop cap, a rotor, a stator, and a motor assembly housing, wherein two bilaterally symmetrical empty cavities are provided within and at an upper portion of the motor assembly housing, the piston A and the piston B are respectively located within the two empty cavities, the piston A divides one empty cavity into an upper air cylinder A and a lower hydraulic cylinder A; similarly, the piston B divides another empty cavity into an upper air cylinder B and a lower hydraulic cylinder B, the upper air cylinder A is corresponding to the upper air cylinder B, the lower hydraulic cylinder A is corresponding to the lower hydraulic cylinder B, the connecting rod is located between the piston A and the piston B, both the air inlet A and the air inlet B are respectively provided above the air cylinder A and the air cylinder B, both the air outlet A and the air outlet B are respectively provided at a top of the air cylinder A and the air cylinder B, the cam, which is located between the air inlet and the air cylinder and coaxially connected with the piston speed control shaft, rotates to control an ON/OFF of the air inlet A, the air inlet B, the air outlet A and the air outlet B, the liquid inlet A and the liquid inlet B are respectively provided on a wall of the hydraulic cylinder A and the hydraulic cylinder B and are communicated with the liquid injecting chamber, a bottom of the hydraulic cylinder A and a bottom of the hydraulic cylinder B are respectively communicated with the liquid storage chamber through the liquid check valve A and the liquid check valve B, the stator, which is located at a lower portion of the motor assembly, is a pipe with helical inner holes, the rotor is located within the stator, and spirally upwardly extends to the liquid storage chamber and connects with the anti-drop cap, the anti-drop cap is threadedly connected with the rotor, an external wall of the rotor, having a helical shape, matches the inner holes of the stator, the stator is conjugatedly engaged with the rotor.

Further, the piston speed control system comprises a battery gasket which is located between the polymer battery pack and the piston speed control housing.

Further, the piston speed control system comprises a piston speed control cover which is located above the piston speed control housing.

Further, the cardan shaft assembly comprises a cardan shaft assembly housing, a cardan shaft located within the cardan shaft assembly housing, and a rotor-cardan shaft joint, wherein the cardan shaft is connected with a bottom of the rotor of the motor assembly through the rotor-cardan shaft joint, for transforming an eccentric motion of the rotor into a rotation around a fixed axis of the transmission shaft, and simultaneously, transmitting a torque to the transmission shaft.

Further, the transmission shaft assembly comprises a transmission shaft, a radial bearing, and a transmission shaft assembly housing, wherein the transmission shaft is located within the transmission shaft assembly housing, and the radial bearing is located between the transmission shaft assembly housing and the transmission shaft.

Further, the transmission shaft assembly comprises an upper radial bearing moving coil, and an upper radial bearing static coil, wherein both the upper radial bearing moving coil and the upper radial bearing static coil are located within a lubrication chamber which is between the transmission shaft assembly housing and the transmission shaft on the radial bearing for lubrication of lubricating oil.

Further, the transmission shaft assembly comprises a lower radial bearing moving coil, and a lower radial bearing static coil, wherein both the lower radial bearing moving coil and the lower radial bearing static coil are located within a lubrication chamber which is between the transmission shaft assembly housing and the transmission shaft below the radial bearing for lubrication of lubricating oil.

Further, the transmission shaft assembly comprises an upper radial bearing moving coil, an upper radial bearing static coil, a lower radial bearing moving coil and a lower radial bearing static coil, wherein both the upper radial bearing moving coil and the upper radial bearing static coil are located within a lubrication chamber which is between the transmission shaft assembly housing and the transmission shaft on the radial bearing for lubrication of lubricating oil; both the lower radial bearing moving coil and the lower radial bearing static coil are located within a lubrication chamber which is between the transmission shaft assembly housing and the transmission shaft below the radial bearing for lubrication of lubricating oil.

Further, the anti-drop cap is threadedly connected with the rotor.

Beneficial effects of the present invention are as follows. Compared with the prior art, the remote-controlled adjustable-speed screw drill for gas-drive hydraulic-motive during gas drilling, provided by the present invention, utilizes the high-pressure gas injected by the gas drilling to drive the pistons to move back and forth at high-speed, so as to drive the incompressible liquid within the driving screw to achieve the self-circulating motion, the screw rotor is driven to rotate by the liquid, the remotely-controlled speed control system is adapted for controlling the ON/OFF of the gas flowing into the flowing channel of the air cylinders, so as to control the rotation speed and the outputted torque of the screw rotor, for achieving the directional drilling operation of the gas drilling, overcoming the "overspeed" phenomenon of conventional gas screw drills to stably output the torque of the gas drilling for prolonging the service life of the drill. The present invention provides a new device for the gas directional, horizontal and highly deviated drilling technologies.

BRIEF DESCRIPTION OF THE DRAWINGS

To more clearly illustrate the embodiments of the present invention or the technical solutions of the prior art, the drawings that are needed in the descriptions of the embodiments or the prior art are introduced in brief. For common technicians skilled in the art, under the premise of no creative labors, other drawings are also able to be obtained based on these drawings.

Figure 1:
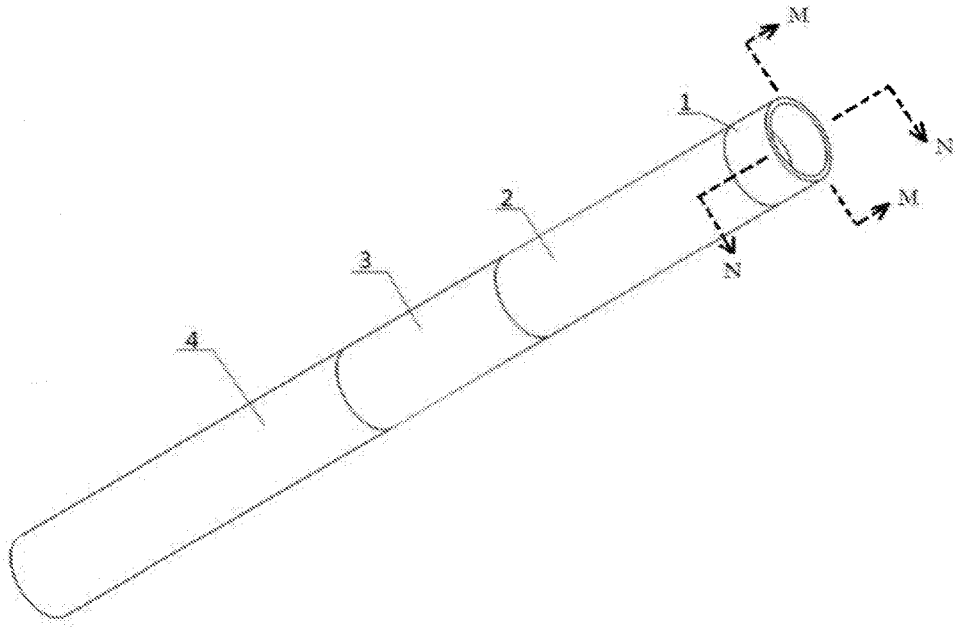
FIG. 1 is a stereo structural view of a remote-controlled adjustable-speed screw drill for gas-drive hydraulic-motive during gas drilling according to a preferred embodiment of the present invention.

In the drawings, 1: piston a piston speed control system; 2: motor assembly; 3: cardan shaft assembly; 4: transmission shaft assembly; 5: air inlet A; 6: air inlet B; 7: cam; 8: air cylinder A; 9: air cylinder B; 10: piston A; 11: piston B; 12: connecting rod; 13: air outlet A; 14: air outlet B; 15: liquid inlet A; 16: liquid inlet B; 17: hydraulic cylinder A; 18: hydraulic cylinder B; 19: liquid check valve A; 20: liquid check valve B; 21: liquid storage chamber; 22: liquid outlet A; 23: liquid outlet B; 24: liquid injecting chamber; 25: liquid injecting hole; 26: anti-drop cap; 27: rotor; 28: stator; 29: motor assembly housing; 30: rotor-cardan shaft joint; 31: cardan shaft; 32: cardan shaft assembly housing; 33: transmission shaft; 34: upper radial bearing moving coil; 35: upper radial bearing static coil; 36: radial bearing; 37: lower radial bearing moving coil; 38: lower radial bearing static coil; 39: transmission shaft assembly housing; 40: a piston speed control cover; 41: piston speed control housing; 42: polymer battery pack; 43: battery gasket; 44: remotely-controlled circuit box; 45: piston speed control motor; 46: piston speed control shaft.

DETAILED DESCRIPTION OF THE PREFERRED EMBODIMENT

Combined with the embodiments of the present invention, the technical solutions of the present invention are clearly and completely described. Obviously, the described embodiments are a partial portion of the present invention, and not the whole embodiments. Based on the embodiments of the present invention, the other embodiments obtained by common technicians skilled in the art, under the premise of no creative labors, belong to the protective scope of the present invention.

The additive aspects and advantages of the present invention are given in the following descriptions, which is obvious in the following descriptions and is able to be understood by the practice of the present invention.

Figure 2:
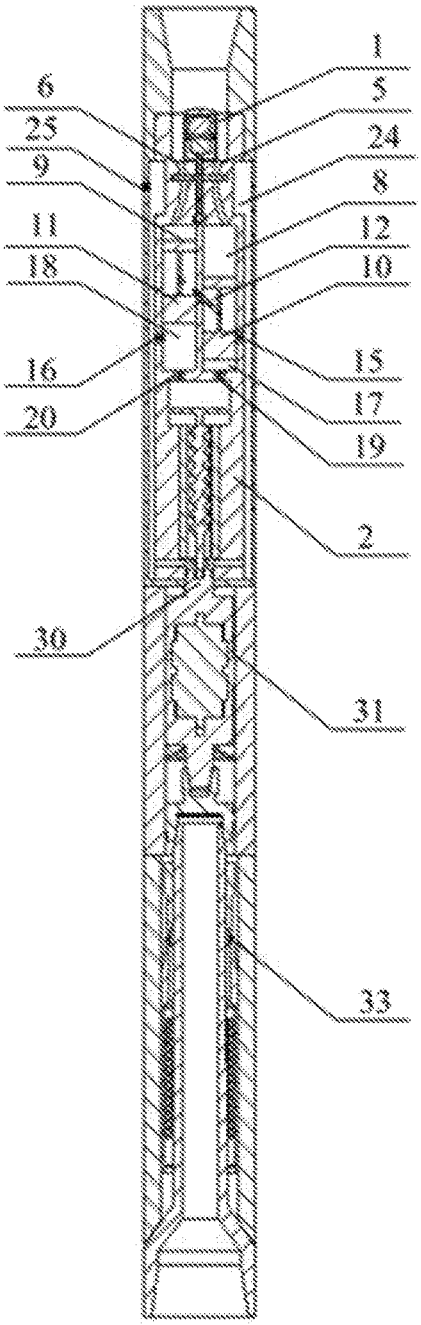
FIG. 2 is an M-M sectional view of the present invention.
Figure 3:
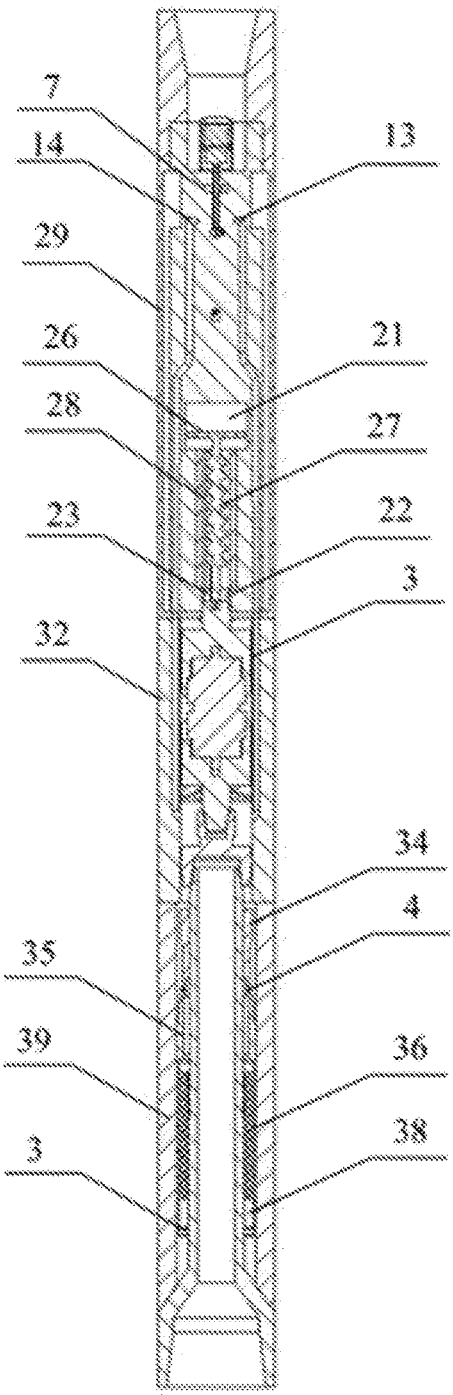
FIG. 3 is an N-N sectional view of the present invention.
Figure 4:
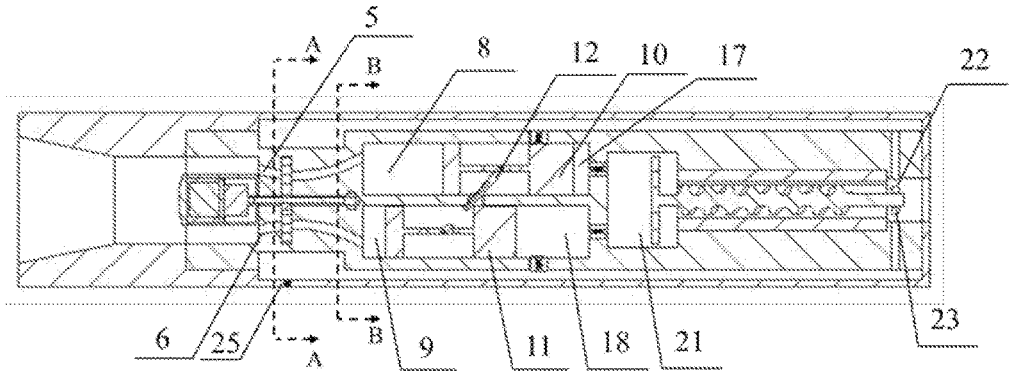
FIG. 4 is a schematic view of a motor assembly along an M-M cross section.
Figure 5:
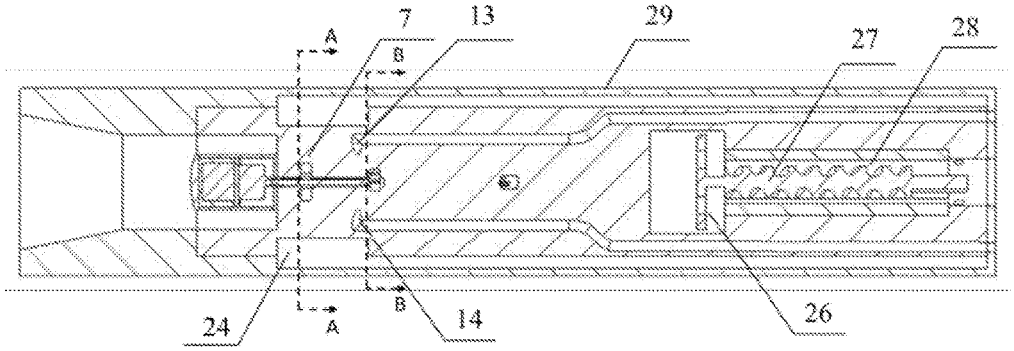
FIG. 5 is a schematic view of a motor assembly along an N-N cross section.

Referring to FIGS. 1-3 of the drawings, a remote-controlled speed-adjustable screw drill for gas-drive hydraulic-motive during gas drilling according to a preferred embodiment of the present invention is illustrated, comprising a piston speed control system 1, a motor assembly 2, a cardan shaft assembly 3 and a transmission shaft assembly 4; an air inlet A 5, an air inlet B 6, a cam 7, an air cylinder A 8, an air cylinder B 9, a piston A 10, a piston B 11, a connecting rod 12, an air outlet A 13, an air outlet B 14, a liquid inlet A 15, a liquid inlet B 16, a hydraulic cylinder A 17, a hydraulic cylinder B 18, a liquid check valve A 19, a liquid check valve B 20, a liquid storage chamber 21, a liquid outlet A 22, a liquid outlet B 23, a liquid injecting chamber 24, a liquid injecting hole 25, an anti-drop cap 26, a rotor 27, a stator 28, a motor assembly housing 29, a rotor-cardan shaft joint 30, a cardan shaft 31, a cardan shaft assembly housing 32, a transmission shaft 33, an upper radial bearing moving coil 34, an upper radial bearing static coil 35, a radial bearing 36, a lower radial bearing moving coil 37, a lower radial bearing static coil 38, a transmission shaft assembly housing 39, a piston speed control cover 40, a piston speed control housing 41, a polymer battery pack 42, a battery gasket 43, a remotely-controlled circuit box 44, a piston speed control motor 45 and a piston speed control shaft 46 are provided.

As shown in FIG. 1, the remote-controlled speed-adjustable screw drill for gas-drive hydraulic-motive during gas drilling comprises the piston speed control system 1, the motor assembly 2, the cardan shaft assembly 3 and the transmission shaft assembly 4 which are connected with each other from top to bottom in sequence.

Figure 12:
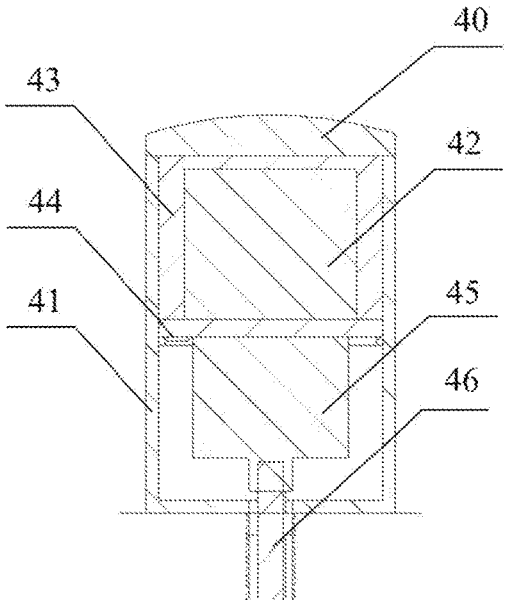
FIG. 12 is a schematic view of a piston speed control system of the present invention.

As shown in FIG. 12, the piston speed control system 1 comprises the piston speed control housing 41, the polymer battery pack 42, the remotely-controlled circuit box 44, the piston speed control motor 45 and the piston speed control shaft 46; wherein the polymer battery pack is located at an upper portion of the piston speed control housing, both the remotely-controlled circuit box and the piston speed control motor are located at the piston speed control housing and below the polymer battery pack in sequence, the piston speed control shaft is connected with a lower portion of the piston speed control motor and extends downwardly, the polymer battery pack provides a DC (direct-current) source for the piston speed control motor, the remotely-controlled circuit box is remotely controlled through a ground for controlling a voltage outputted to the piston speed control motor, so as to control a rotating speed of the piston speed control motor and the piston speed control shaft.

In the present invention, the piston speed control system further comprises the battery gasket 43 which is located between the polymer battery pack and the piston speed control housing for shock prevention and fixation.

To protect the polymer battery pack, the piston speed control system further comprises the piston speed control cover which is located above the piston speed control housing.

As shown in FIGS. 2-5, the motor assembly 2 comprises the air inlet A 5, the air inlet B 6, the cam 7, the air cylinder A 8, the air cylinder B 9, the piston A 10, the piston B 11, the connecting rod 12, the air outlet A 13, the air outlet B 14, the liquid inlet A 15, the liquid inlet B 16, the hydraulic cylinder A 17, the hydraulic cylinder B 18, the liquid check valve A 19, the liquid check valve B 20, the liquid storage chamber 21, the liquid outlet A 22, the liquid outlet B 23, the liquid injecting chamber 24, the liquid injecting hole 25, the anti-drop cap 26, the rotor 27, the stator 28, and the motor assembly housing 29. Two bilaterally symmetrical empty cavities are provided within and at an upper portion of the motor assembly housing. A piston A and a piston B are respectively located within the two empty cavities, the piston A divides the two empty cavities into an upper air cylinder A and a lower hydraulic cylinder A; similarly, the piston B divides the two empty cavities into an upper air cylinder B and a lower hydraulic cylinder B, wherein the upper air cylinder A is corresponding to the upper air cylinder B, the lower hydraulic cylinder A is corresponding to the lower hydraulic cylinder B. The connecting rod is located between the piston A and the piston B. Both the air inlet A and the air inlet B are respectively provided above the air cylinder A and the air cylinder B; and both the air outlet A and the air outlet B are respectively provided at a top of the air cylinder A and the air cylinder B. The cam, located between the air inlet and the air cylinder, and coaxially connected with the piston speed control shaft, rotates to control an ON/OFF of the air inlet A, the air inlet B, the air outlet A and the air outlet B. The liquid inlet A and the liquid inlet B are respectively provided on a wall of the hydraulic cylinder A and the hydraulic cylinder B, and are communicated with the liquid injecting chamber. A bottom of the hydraulic cylinder A and a bottom of the hydraulic cylinder B are respectively communicated with the liquid storage chamber through the liquid check valve A and the liquid check valve B. The stator, located at a lower portion of the motor assembly, is a pipe with helical inner holes. The rotor is located within the stator, and spirally upwardly extends to the liquid storage chamber and connects with the anti-drop cap. The anti-drop cap is threadedly connected with the rotor. An external wall of the rotor, having a helical shape, matches the inner holes of the stator. The stator is conjugatedly engaged with the rotor.

The motor assembly housing is connected with an upper portion of the drill, ground high-pressure gas enters an air cylinder channel of the screw drill through the upper portion of the drill and the motor assembly housing, the piston speed control system controls the cam to rotate at a constant speed for controlling the ON/OFF of the air inlets and the air outlets of the air cylinder A and the air cylinder B; when the air inlet A of the air cylinder A is ON, the air inlet B of the air cylinder B is OFF, and meanwhile, the air outlet A of the air cylinder A is OFF, and the air outlet B of the air cylinder B is ON; the high-pressure gas enters the air cylinder A through the air inlet A for driving the piston A to move, so as to drive the liquid inlet A of the hydraulic cylinder A to close, and drive liquid in the hydraulic cylinder A to enter the liquid storage chamber through the liquid check valve A, and meanwhile, due to the piston A is connected with the piston B via the connecting rod, the piston B moves towards an opposite direction to absorb self-circulating liquid from the liquid inlet B and discharge gas outside the air cylinder B through the air outlet B.

The cardan shaft assembly comprises the cardan shaft assembly housing 32, the cardan shaft 31 located within the cardan shaft assembly housing, and a rotor-cardan shaft joint 30, wherein the cardan shaft is connected with a bottom of the rotor of the motor assembly through the rotor-cardan shaft joint, for transforming an eccentric motion of the rotor into a rotation around a fixed axis of the transmission shaft, and simultaneously, transmitting a torque to the transmission shaft.

The transmission shaft assembly comprises the transmission shaft 33, the radial bearing 36, and the transmission shaft assembly housing 39, wherein the transmission shaft is located within the transmission shaft assembly housing, and the radial bearing is located between the transmission shaft assembly housing and the transmission shaft.

To ensure a smooth operation of the transmission shaft, the transmission shaft assembly further comprises the upper radial bearing moving coil 34, the upper radial bearing static coil 35, the lower radial bearing moving coil 37, and the lower radial bearing static coil 38; wherein both the upper radial bearing moving coil and the upper radial bearing static coil are located within a lubrication chamber which is between the transmission shaft assembly housing and the transmission shaft on the radial bearing for lubrication of lubricating oil; both the lower radial bearing moving coil and the lower radial bearing static coil are located within a lubrication chamber which is between the transmission shaft assembly housing and the transmission shaft below the radial bearing for lubrication of lubricating oil; the transmission shaft assembly bears a bending load caused by a planetary motion of the rotor, and a lateral force caused by a rotation of a drilling bit, for ensuring that the transmission shaft is capable of stably outputting the torque and transmitting a bit pressure.

Figure 6:
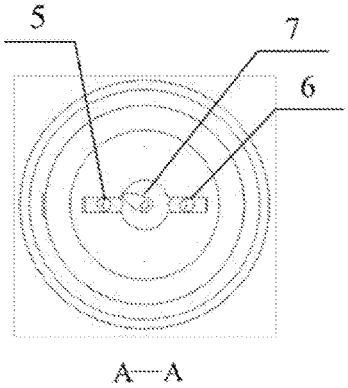
FIG. 6 is an A-A sectional view of FIGS. 4 and 5, and shows a cam structure of an air injecting channel of an air cylinder of the present invention.

Referring to FIG. 6, the cam is rotated to control the ON/OFF of the air inlet A, the air inlet B, the air outlet A and the air outlet B, and the gas to flow in or out of the air cylinder A and the air cylinder B.

Figure 7:
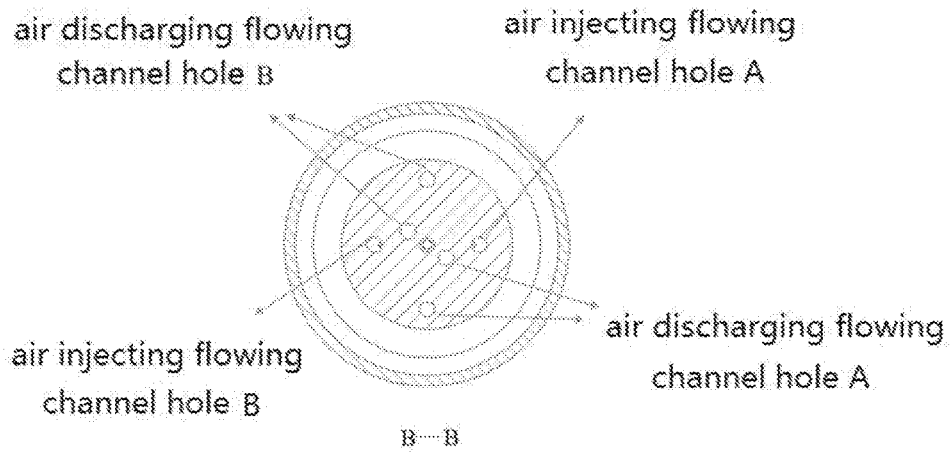
FIG. 7 is a B-B sectional view of FIGS. 4 and 5, and shows an air injecting channel hole and an air discharging channel hole of an air cylinder of the present invention.
Figure 8:
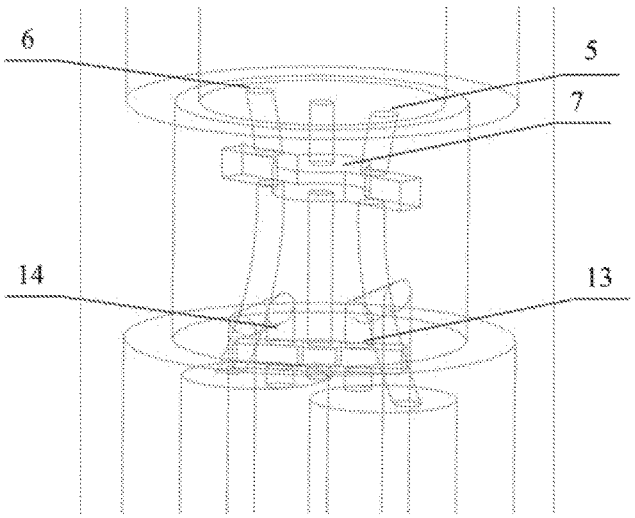
FIG. 8 is a three-dimensional schematic view of the cam of the present invention.

Referring to FIGS. 7 and 8, through an air discharging channel of two air cylinders, the high-pressure gas from the upper drilling string passes by an air injecting channel at a top of the two air cylinders, enters the cardan shaft assembly flowing channel and the transmission shaft assembly flowing channel which are located at a lower portion of the screw, bit nozzles, annulus and ground, so that it is achieved that the gas acts as a well-drilling circulating medium. Therefore, there are two air injecting holes and four air discharging holes in B-B sectional view.

Figure 9:
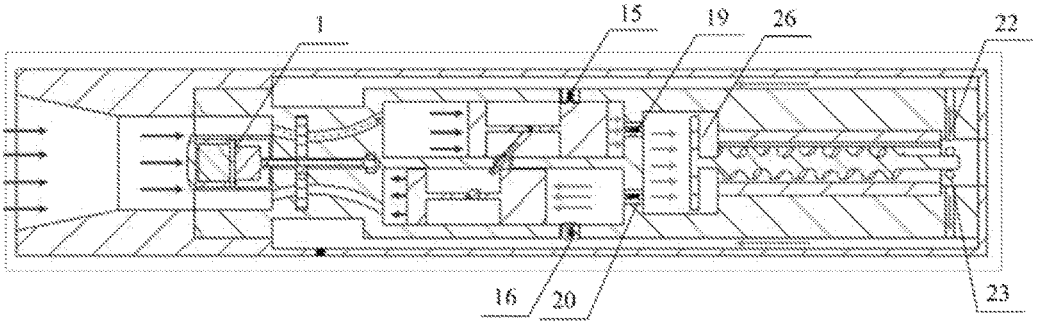
FIG. 9 shows the air and liquid motional trajectories while the pistons of the motor assembly moving up and down of the present invention.

Referring to FIG. 9, after the liquid with a pressure energy enters the liquid storage chamber, a sealing chamber between the rotor and the stator is formed, changed and lost, so as to force the rotor to continuously move in the stator; the rotor drives the cardan shaft to rotate, and then drives the transmission shaft to rotate, the radial sliding bearing in the transmission shaft assembly bears axial and radial loads produced by drilling to ensure that the transmission shaft is capable of stably outputting the torque, and then the transmission shaft transmits a rotating power of the motor to the drilling bit. The liquid is discharged through the liquid outlet A and the liquid outlet B at the bottom of the rotor, and flows into a liquid circulating channel; when the liquid inlet B is ON, the liquid flows into the hydraulic cylinder A. The circulating liquid is capable of being added to the liquid injecting chamber through the liquid injecting hole on the ground, so as to ensure that there is sufficient liquid in the motor to meet demands for driving the rotor. Therefore, the liquid achieves a self circulation in the motor of the screw drill; the liquid drives the rotor to rotate, so that the present invention overcomes an "overspeed" phenomenon of conventional gas screws, thereby achieving a stable output of the torque of the gas well drilling to prolong a service life of the drill.

Figure 10:
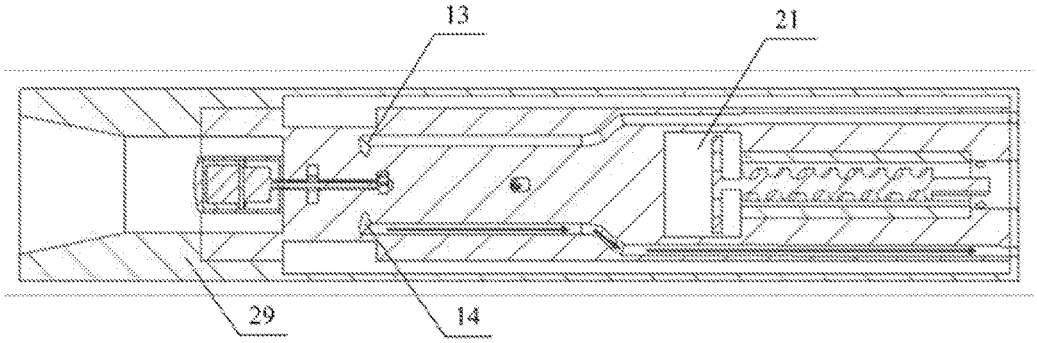
FIG. 10 shows the air discharging motional trajectories while the pistons of the motor assembly moving up and down of the present invention.
Figure 11:
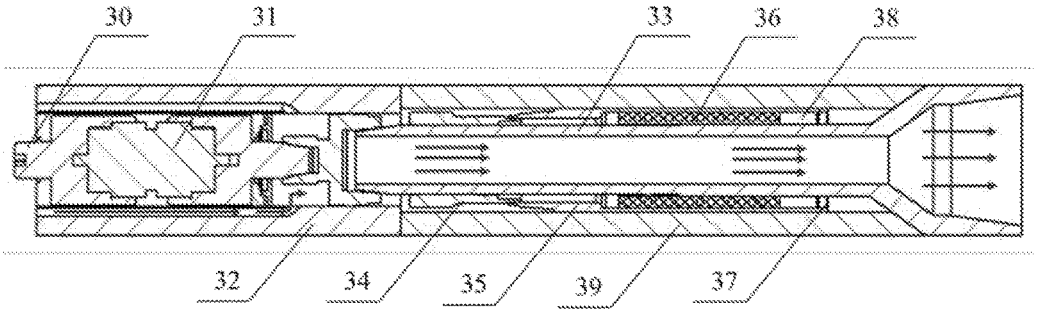
FIG. 11 shows the air discharging motional trajectories in the cardan shaft assembly and the transmission shaft assembly of the present invention.

Referring to FIGS. 10 and 11, the gas discharged by the motor enters an air flowing channel in the motor through the air outlet B, and enters the transmission shaft through the cardan shaft assembly, and finally enters the drilling bit, so as to achieve the flow of the gas in the screw drill. The cardan shaft transforms the eccentric motion of the rotor into the rotation around the fixed axis, and combined with the transmission shaft assembly, stably outputs a rotation speed and the torque of the motor to the drilling bit.

Figure 13:
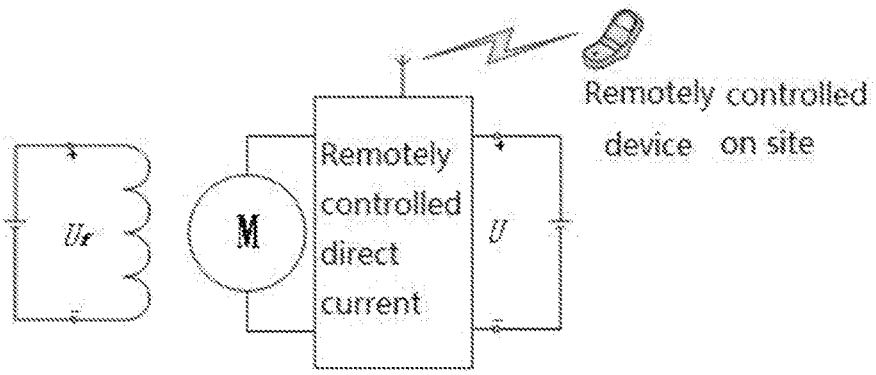
FIG. 13 is a remotely-controlled circuit diagram of the piston speed control system of the present invention.

Referring to FIG. 13, a signal is sent by an on-site remotely-controlled device, the remotely-controlled circuit box receives a ground remotely-controlled signal, and then regulates an output voltage according to the ground remotely-controlled signal, for regulating the rotation speed of the piston speed control motor among five grades, so as to control the gas to flow in and out of the air cylinders, thereby achieving a screw speed control.

Two end of the gas well-drilling screw drill are box joints, wherein one end is connected with the upper portion of the drill, and another end is connected with the drilling bit.

One skilled in the art is able to understand, except additional definitions, these used terminologies (including technical terminologies and scientific terminologies) have same meanings with common understandings of ordinary technicians in the art. Furthermore, it should be understood that, those terminologies defined in universal dictionaries should be understood as same meanings with meanings in the context of the prior art; and except for definitions like this, idealized or overformal meanings are not used to explain.

Ordinary technicians in the art are able to understand that: the components of the device in the embodiment are able to distribute in the device of the embodiment according to the description of the embodiment, and also able to change for distributing in one or more devices different from the embodiment. The components of the above embodiment are able to be emerged into one component, and also able to be further divided into a plurality of sub-components.

Finally, it should be noted that: one skilled in the art will understand that the embodiment of the present invention as shown in the drawings and described above is exemplary only and not intended to be limiting. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A remote-controlled adjustable-speed screw drill for gas-drive hydraulic-motive during gas drilling, comprising a piston speed control system, a motor assembly, a cardan shaft assembly and a transmission shaft assembly which are connected with each other from top to bottom in sequence; wherein:

the piston speed control system comprises a piston speed control housing, a polymer battery pack, a remotely-controlled circuit box, a piston speed control motor and a piston speed control shaft, wherein the polymer battery pack is located at an upper portion of the piston speed control housing, both the remotely-controlled circuit box and the piston speed control motor are located at the piston speed control housing and below the polymer battery pack, the piston speed control shaft is connected with a lower portion of the piston speed control motor and extends downwardly;

the motor assembly comprises an air inlet A, an air inlet B, a cam, an air cylinder A, an air cylinder B, a piston A, a piston B, a connecting rod, an air outlet A, an air outlet B, a liquid inlet A, a liquid inlet B, a hydraulic cylinder A, a hydraulic cylinder B, a liquid check valve A, a liquid check valve B, a liquid storage chamber, a liquid outlet A, a liquid outlet B, a liquid injecting chamber, a liquid injecting hole, an anti-drop cap, a rotor, a stator, and a motor assembly housing, wherein two bilaterally symmetrical empty cavities are provided within and at an upper portion of the motor assembly housing, the piston A and the piston B are respectively located within the two empty cavities, the piston A divides one empty cavity into an upper air cylinder A and a lower hydraulic cylinder A; similarly, the piston B divides another empty cavity into an upper air cylinder B and a lower hydraulic cylinder B, the upper air cylinder A is corresponding to the upper air cylinder B, the lower hydraulic cylinder A is corresponding to the lower hydraulic cylinder B, the connecting rod is located between the piston A and the piston B, both the air inlet A and the air inlet B are respectively provided above the air cylinder A and the air cylinder B, both the air outlet A and the air outlet B are respectively provided at a top of the air cylinder A and the air cylinder B, the cam, which is located between the air inlet and the air cylinder and coaxially connected with the piston speed control shaft, rotates to control an ON/OFF of the air inlet A, the air inlet B, the air outlet A and the air outlet B, the liquid inlet A and the liquid inlet B are respectively provided on a wall of the hydraulic cylinder A and the hydraulic cylinder B and are communicated with the liquid injecting chamber, a bottom of the hydraulic cylinder A and a bottom of the hydraulic cylinder B are respectively communicated with the liquid storage chamber through the liquid check valve A and the liquid check valve B, the stator, which is located at a lower portion of the motor assembly, is a pipe with helical inner holes, the rotor is located within the stator, and spirally upwardly extends to the liquid storage chamber and connects with the anti-drop cap, the anti-drop cap is threadedly connected with the rotor, an external wall of the rotor, having a helical shape, matches the inner holes of the stator, the stator is conjugatedly engaged with the rotor.

2. The remote-controlled adjustable-speed screw drill for gas-drive hydraulic-motive during gas drilling, as recited in claim 1, wherein the piston speed control system further comprises a battery gasket which is located between the polymer battery pack and the piston speed control housing.

3. The remote-controlled adjustable-speed screw drill for gas-drive hydraulic-motive during gas drilling, as recited in claim 1, wherein the piston speed control system further comprises a piston speed control cover which is located above the piston speed control housing.

4. The remote-controlled adjustable-speed screw drill for gas-drive hydraulic-motive during gas drilling, as recited in claim 2, wherein the piston speed control system further comprises a piston speed control cover which is located above the piston speed control housing.

5. The remote-controlled adjustable-speed screw drill for gas-drive hydraulic-motive during gas drilling, as recited in claim 1, wherein the cardan shaft assembly comprises a cardan shaft assembly housing, a cardan shaft located within the cardan shaft assembly housing, and a rotor-cardan shaft joint, wherein the cardan shaft is connected with a bottom of the rotor of the motor assembly through the rotor-cardan shaft joint, for transforming an eccentric motion of the rotor into a rotation around a fixed axis of the transmission shaft, and simultaneously, transmitting a torque to the transmission shaft.

6. The remote-controlled adjustable-speed screw drill for gas-drive hydraulic-motive during gas drilling, as recited in claim 1, wherein the transmission shaft assembly comprises a transmission shaft, a radial bearing, and a transmission shaft assembly housing, wherein the transmission shaft is located within the transmission shaft assembly housing, and the radial bearing is located between the transmission shaft assembly housing and the transmission shaft.

7. The remote-controlled adjustable-speed screw drill for gas-drive hydraulic-motive during gas drilling, as recited in claim 6, wherein the transmission shaft assembly further comprises an upper radial bearing moving coil, and an upper radial bearing static coil, wherein both the upper radial bearing moving coil and the upper radial bearing static coil are located within a lubrication chamber which is between the transmission shaft assembly housing and the transmission shaft on the radial bearing for lubrication of lubricating oil.

8. The remote-controlled adjustable-speed screw drill for gas-drive hydraulic-motive during gas drilling, as recited in claim 6, wherein the transmission shaft assembly further comprises a lower radial bearing moving coil, and a lower radial bearing static coil, wherein both the lower radial bearing moving coil and the lower radial bearing static coil are located within a lubrication chamber which is between the transmission shaft assembly housing and the transmission shaft below the radial bearing for lubrication of lubricating oil.

9. The remote-controlled adjustable-speed screw drill for gas-drive hydraulic-motive during gas drilling, as recited in claim 6, wherein the transmission shaft assembly further comprises an upper radial bearing moving coil, an upper radial bearing static coil, a lower radial bearing moving coil and a lower radial bearing static coil, wherein both the upper radial bearing moving coil and the upper radial bearing static coil are located within a first lubrication chamber which is between the transmission shaft assembly housing and the transmission shaft on the radial bearing for lubrication of lubricating oil; both the lower radial bearing moving coil and the lower radial bearing static coil are located within a second lubrication chamber which is between the transmission shaft assembly housing and the transmission shaft below the radial bearing for lubrication of lubricating oil.

* * * * *